United States Patent [19]

Lloyd, III et al.

[11] 4,361,104

[45] * Nov. 30, 1982

[54] TWIN HULL SEMISUBMERSIBLE DERRICK BARGE

[75] Inventors: Samuel H. Lloyd, III; Yoram Goren, both of Los Angeles, Calif.

[73] Assignee: Santa Fe International Corporation, Orange, Calif.

[ * ] Notice: The portion of the term of this patent subsequent to Sep. 17, 1991, has been disclaimed.

[21] Appl. No.: 38,729

[22] Filed: May 14, 1979

Related U.S. Application Data

[60] Division of Ser. No. 22,506, Mar. 21, 1979, Pat. No. 4,273,067, which is a division of Ser. No. 732,117, Oct. 13, 1976, Pat. No. 4,150,635, which is a division of Ser. No. 650,953, Jan. 21, 1976, abandoned, which is a continuation of Ser. No. 486,588, Jul. 8, 1974, abandoned, which is a division of Ser. No. 161,865, Jul. 9, 1971, Pat. No. 3,835,800, which is a continuation of Ser. No. 705,175, Feb. 13, 1968, abandoned.

[51] Int. Cl.[3] ..... B63B 35/44

[52] U.S. Cl. ..... 114/258; 212/192

[58] Field of Search ..... 114/61, 65 R, 258, 261, 114/264, 265; 212/190, 191, 192

[56] References Cited

U.S. PATENT DOCUMENTS 3,835,800 9/1974 Lloyd et al. ..... 114/265

4,150,635 4/1979 Lloyd et al. ..... 114/264

4,273,067 6/1981 Lloyd et al. ..... 114/258

*Primary Examiner*—Charles E. Frankfort

*Attorney, Agent, or Firm*—LeBlanc, Nolan, Shur & Nies

[57] ABSTRACT

The derrick barge comprises a pair of laterally spaced elongated hulls having a plurality of upstanding columns spaced therealong supporting a working platform and a heavy duty derrick or crane in spaced relation above the hulls. The hulls bouyantly support the vessel including its deck load in the floating condition with the hulls having freeboard. The hulls have ballast compartments to submerge the hulls and portions of the stabilizing columns to a distance of approximately one-half the effective height of the stabilizing columns to maintain the vessel in a semisubmerged floating condition with the platform and derrick elevated above the waterline. However, the vessel also may be ballasted or deballasted to submerge or emerge to a greater or lesser extent from the semisubmerged condition such that the distance between the mean water surface and either the underside of the deck or top side of the hull is not less than 0.75 of the mean wave height. The columns stabilize the vessel in the semisubmerged condition about roll and pitch axes. The heavy duty derrick is located adjacent the stern portion of the vessel with its vertical axis of rotation intersecting the vessel centerline. This novel twin hull column stabilized derrick barge arrangement has excellent motion minimizing characteristics under wave action in operations at sea.

19 Claims, 14 Drawing Figures

FIG. 6
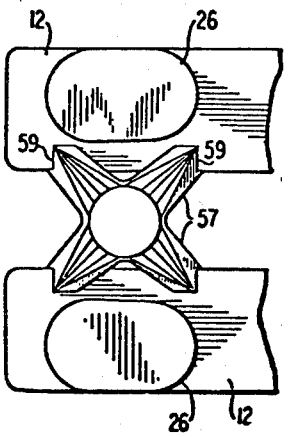
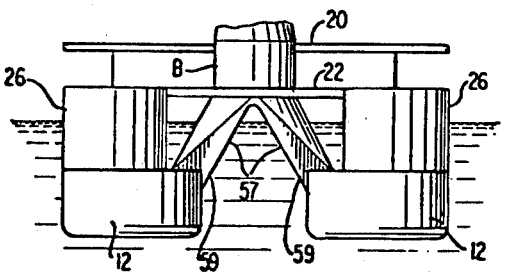
FIG. 7
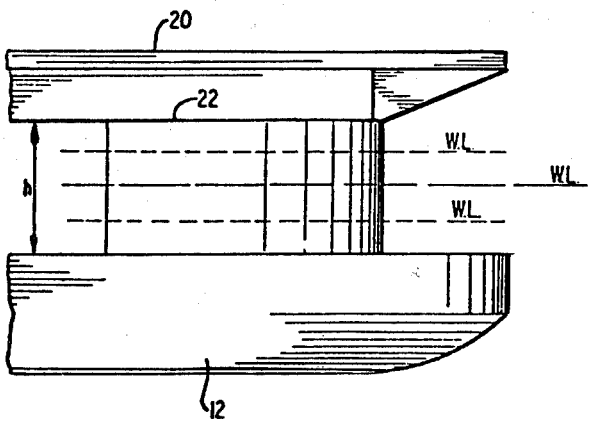
FIG. 9

TWIN HULL SEMISUBMERSIBLE DERRICK BARGE

This application is a division of applicants' copending application Ser. No. 22,506, filed Mar. 21, 1979, now U.S. Pat. No. 4,273,067, which is a division of application Ser. No. 732,117 filed Oct. 13, 1976, now U.S. Pat. No. 4,150,635, which is a division of Ser. No. 650,953, filed Jan. 21, 1976 (now abandoned); said application Ser. No. 650,953 is a continuation of applicants' application Ser. No. 486,588 filed July 8, 1974 (now abandoned); said application Ser. No. 486,588 is a division of applicants' application Ser. No. 161,865 filed July 9, 1971 and issued on Sept. 17, 1974 as U.S. Pat. No. 3,835,800; said application Ser. No. 161,865 is a continuation of applicants' application Ser. No. 705,175 filed Feb. 13, 1968 (now abandoned).

BACKGROUND OF THE INVENTION

This invention relates to a twin hull, semisubmersible floating vessel and more specifically to a semisubmersible barge mounting a heavy duty derrick or crane for use in offshore, particularly deep water, construction including, for example the erection and dismantling of oil drilling and production platforms as well as other offshore lifting and transfer functions.

Offshore activities, such as current attempts to drill and exploit oil wells at sea, have led to the development and construction of various special purpose marine structures capable of operations in the offshore environment over extended periods of time. For example, one such structure employed in offshore oil drilling operations comprises a fixed, self-contained drilling platform erected on piles driven into the sea floor, with the platform mounting a drilling rig, auxiliary equipment and crew's quarters. A variation of the foregoing structure provides a somewhat smaller platform similarly erected on piles and having a drilling rig located thereon, the auxiliary equipment and crew being located on a tender tied alongside.

To erect structures in the offshore environment as well as to dismantle the same as in the case of discontinued oil drilling and production platforms and other structures, barges mounting heavy duty derricks or cranes have been employed to lift, transfer and set into place the parts forming such structures. For example, current methods of offshore construction, particularly the construction of oil drilling and production platforms, employ such barges to drive piles at the construction site on which the platform is mounted. Present practice provides for the assembly on land of the component parts of the platform to form subassemblies which are then loaded aboard derrick or crane barges for transport to the construction site. At the site, these barges provide a work deck from which the subassemblies are offloaded by the heavy duty derricks or cranes mounted on the barges and assembled to form the completed structure.

Present derrick or crane barges employed for this purpose comprise single hull surface floating vessels which are either towed or self-propelled to and anchored at the construction site. Platform erecting and dismantling operations conducted from barges of this type are, however, highly restricted by sea state conditions, since excessive vessel motion in heave, pitch and roll precludes crane or derrick operations. For example, surface floating derrick or crane barges currently employed for offshore construction can operate in sea states having wave heights up to about 5 feet or in special cases 6 feet. The wave action against the vessel caused by sea states having wave heights in excess of these limits normally causes excessive vessel motion precluding derrick or crane operations. Construction operations utilizing present day barges are thus normally halted when these high sea state conditions are encountered and are resumed only when the sea state subsides to within the above-noted limits.

The main problems that present day vessels of this type encounter are (1) their natural period in roll, pitch and heave is inherently low and (2) their GM (distance between center of gravity and metacenter GM) is inherently high. The low natural periods are more apt to be close to the period of the waves thus causing motion amplification. The high GM values result in abrupt correcting motions when the vessels are submitted to roll or pitch excitations. This may damage the equipment, bring about structural or wire failures of the derrick due to excessive acceleration forces and cause discomfort to personnel.

Accordingly, it is a primary object of the present invention to provide a derrick barge or crane barge which minimizes the above-discussed and other shortcomings of prior vessels employed for like purposes and provides various advantages in construction, mode of operation and result over prior vessels. [The terms "derrick" or "crane" are employed hereinafter interchangeably and the vessel or barge mounting either one or the other is herein referred to as a derrick barge.]

It is another object of the present invention to provide a twin hull, semisubmersible barge mounting a heavy duty derrick for offshore construction work.

It is still another object of the present invention to provide a semisubmersible twin hull derrick barge which, particularly when in floating semisubmerged condition, has the characteristic of minimizing vessel motion due to excitation forces caused by wave action (hereinafter called "motion minimizing characteristics"). It is a related object to provide such a derrick barge affording improved motion minimizing characteristics in vessel pitch, roll and heave as well as minimizing sideslip and surge.

It is yet another object of the invention to provide a derrick barge comprising a platform and a derrick mounted in spaced relation above a pair of hulls and which can be selectively ballasted or deballasted from its normal semisubmerged floating condition to obtain even better motion minimizing characteristics when the period of the waves is the same or close to the natural period of the vessel, thereby tending to produce vessel motion amplification.

It is another related object of the present invention to provide a twin hull semisubmersible derrick barge having long natural periods in roll, pitch and heave and a lower GM in the semisubmerged condition as compared with its GM in the surface floating condition (low draft).

It is a further object of the present invention to provide a semisubmersible derrick barge having rapid mobility in transit, the ability to carry large deck loads in the surface floating condition and a beam providing for transit of the barge through the Panama Canal.

It is a still further object of the present invention to provide, in a barge mounting a heavy duty derrick, a method of coordinating operation of the derrick and the ballasting of the barge as to enable operation of the derrick when its permissible slew angle would otherwise be exceeded, and also to maintain heel angle of the vessel within limits acceptable for comfort of the crew.

These and other related objects and advantages of the present invention will become more apparent from the following specification, claims and appended drawings wherein:

DESCRIPTION OF THE DRAWINGS

FIG. 6 is a fragmentary plan view of the barge with portions broken away, illustrating the derrick support structure;

FIG. 7 is an aft end elevational view thereof illustrating the derrick support structure;

FIG. 9 is a fragmentary side elevational view of the derrick barge illustrating the operating limits when in the semisubmerged floating condition;

DESCRIPTION OF A PREFERRED EMBODIMENT

Figure 1:
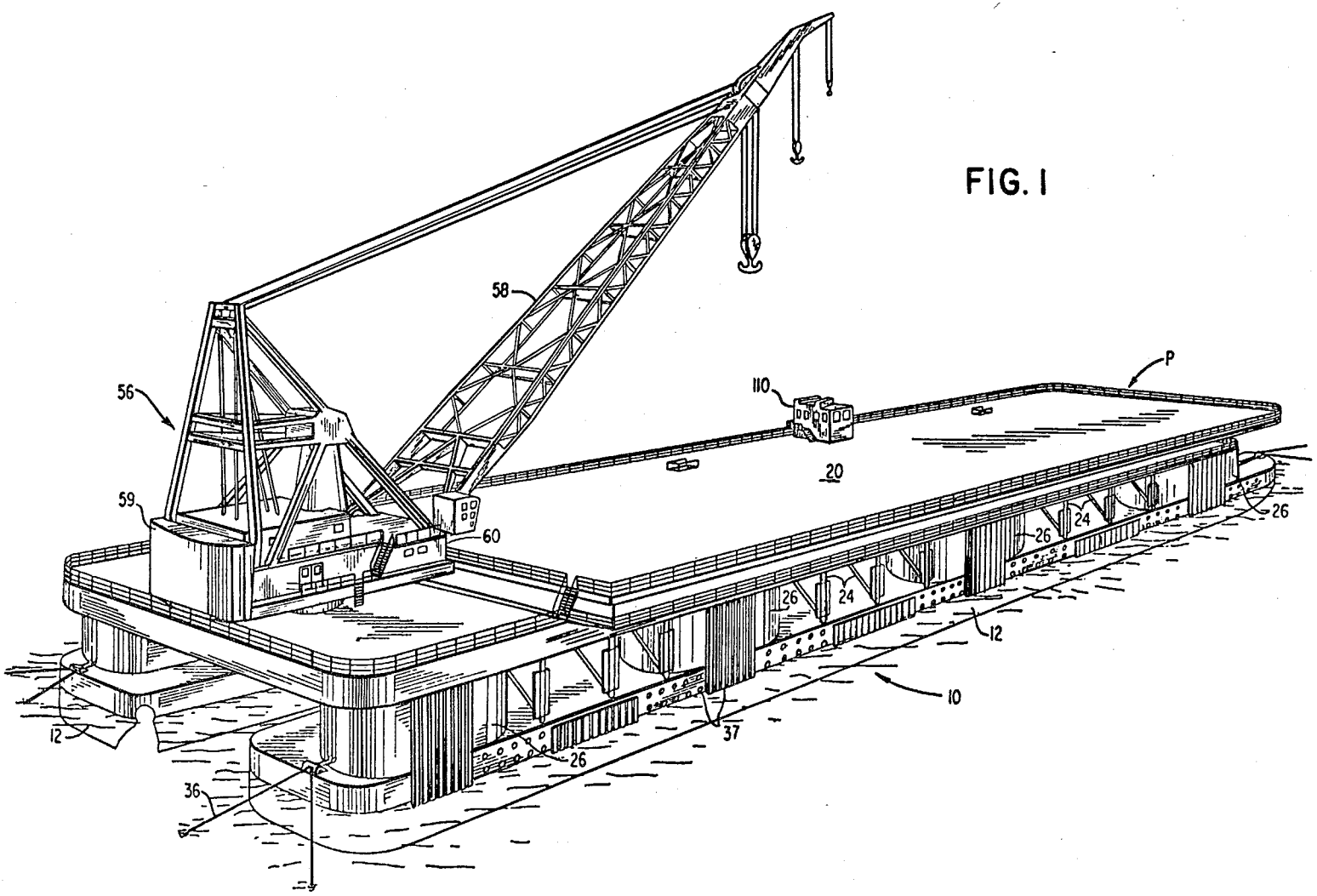
FIG. 1 is a perspective view of a twin hull semisubmerged derrick barge constructed in accordance with the present invention.
Figures 2, 10A, 10B, 10C, 10D:
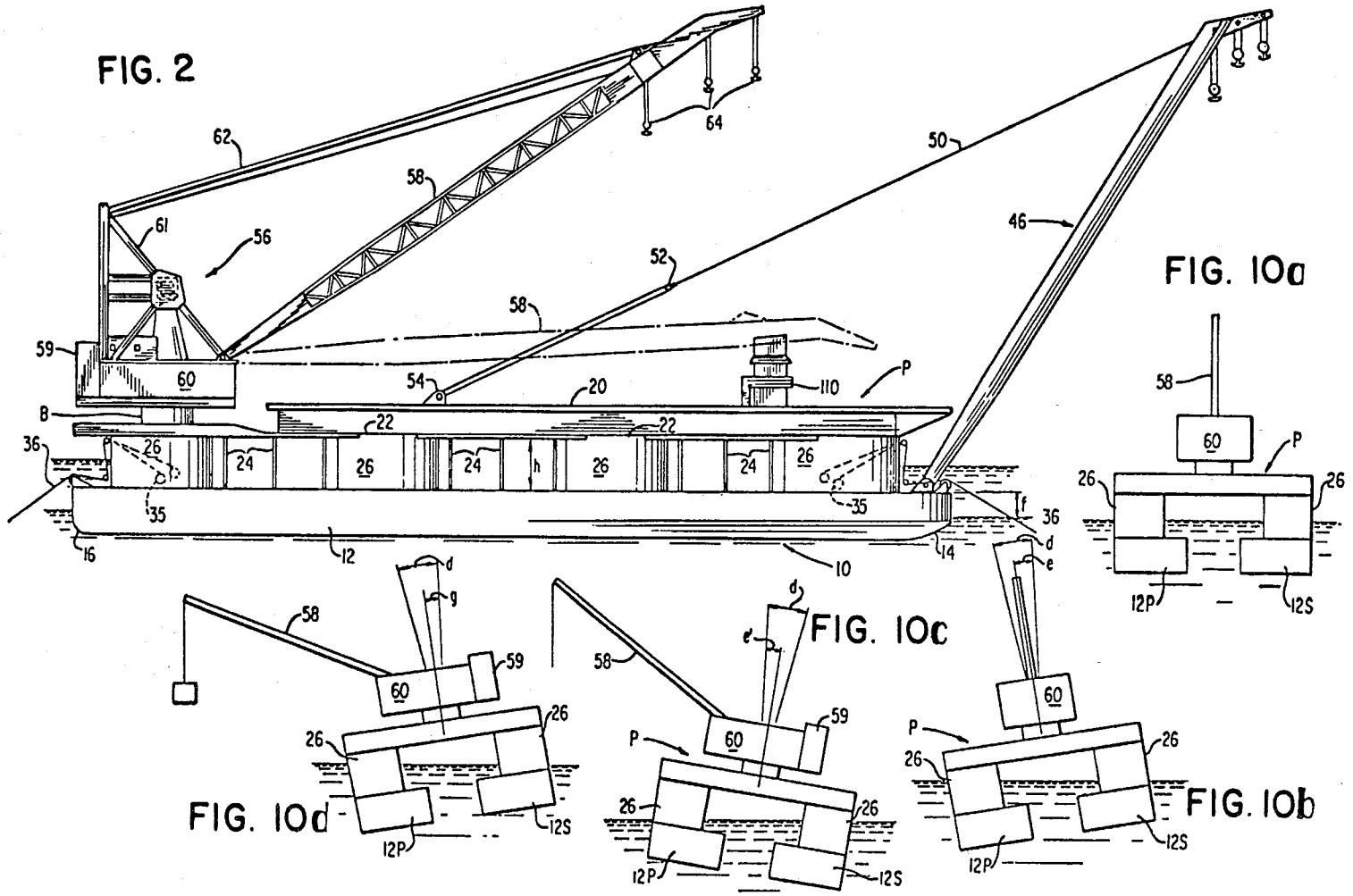
FIG. 2 is a side elevational view of the derrick barge with the waterline being illustrated relative to the barge in both the surface and semisubmerged floating conditions.
FIGS. 10*a*–10*d* are schematic aft end elevational views of the derrick barge hereof illustrating the various angular positions thereof in exaggerated form when operating the derrick to pick up load with the crane to beam; and using ballast transfer.
Figure 4:
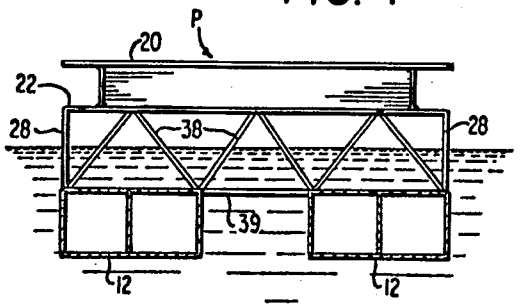
FIG. 4 is a cross-sectional view thereof taken on lines 4—4 in FIG. 3.
Figure 5:
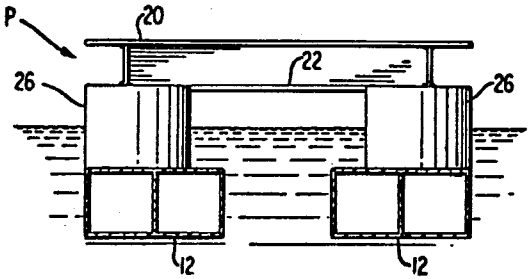
FIG. 5 is a cross-sectional view thereof taken on lines 5—5 in FIG. 3.

Referring to the drawings, particularly FIGS. 1 and 2, there is shown a semisubmersible derrick barge or vessel generally indicated at 10 comprising a pair of transversely spaced, elongated hulls 12 extending in spaced parallel relation and providing sufficient displacement to support vessel 10 in the floating condition with the hulls having freeboard indicated at f in FIG. 2. [Each hull 12 has a substantially rectangular cross section as seen in FIGS. 4 and 5, an arcuate bow portion 14 and a round stern bottom portion 16. Hulls 12 are thus sufficiently streamlined in shape to minimize resistance to towing when vessel 10 is entirely supported by hulls 12 in the floating condition.]

A platform P comprising a main deck 20 and a lower deck 22 is supported a predetermined height above hulls 12 by support structure including a plurality of longitudinally spaced, transversely extending truss formations generally indicated at 24 and a plurality of longitudinally spaced pairs of transversely spaced stabilizing columns 26 hereinafter referred to as columns. A plurality of truss formations 24 are longitudinally spaced between longitudinally spaced pairs of columns 26 and each truss including as best seen in FIG. 4 two outermost support members 28 upstanding from each hull 12 to the outer edges of lower deck 22. Each truss 24 includes a plurality of diagonally and transversely extending beams 38 secured between hulls 12 and lower deck 22 providing for platform P. Trusses 24 include transversely extending, horizontal cross braces 39 joining the upper inner sides of hulls 12. Similar diagonally and transversely extending truss formations 40 connect between hulls 12 in the area between columns 26 as seen in FIG. 5.

As discussed more fully hereinafter, the support structure also includes stabilizing columns 26 extending upwardly from the upper surface of hulls 12 to platform P an effective height h (FIG. 2) which may be equal to and preferably greater than the maximum anticipated wave height, the vertical distance between wave crest and trough. In the preferred embodiment, four pairs of columns 26 are equally longitudinally spaced one from the other along hulls 12 with the column arrangement on each hull being symmetrical with respect to the other hull. As shown by the dashed lines in FIG. 3, columns 26 preferably are generally oblong shaped with longitudinally elongated vertical sides and semicylindrical fore and aft vertical end sections 42. It will be understood, however, that columns 26 may have circular, square or other cross-sectional configurations as desired. Use of columns 26 provides motion minimizing characteristics when the vessel is in the floating semisubmerged condition. Stabilizing columns 26 are preferably constant in cross-sectional area throughout their effective length. It will be understood that either or both the upper and lower ends of the columns may be reduced in cross section, for example, to form frustoconical sections, to provide mechanical connection between the columns and the hulls and platform which do not substantially affect the effective height or make the latter subject thereto.

As seen in FIG. 2, the lower ends of the legs 44 of a shear leg generally indicated at 46 are pivotally mounted to bow portions of hulls 12 as at 48. The vertical inclination of shear leg 46 is controlled by a hoist cable 50 connected to a block, not shown, located at the upper end of shear leg 46 and to a pulley block 52 at its lower end which connects with a power-driven drum apparatus 54 whereby the inclination of shear leg 46 may be selectively altered.

A heavy duty derrick or crane, generally indicated at 56 and hereinafter referred to as derrick, comprises a boom 58 and a housing 60, derrick 56 being pivotally mounted on a support structure including girders extending upwardly from stern portions of hulls 12 locating the base structure B of derrick 56 at a level coincident with lower deck 22 of platform P. As seen in FIGS. 6 and 7, the support girders may comprise four inwardly and upwardly directed columns formed by girders 57 with foot or base portions 59 of each lateral pair of girder columns 57 being secured to the inboard sides of stern portions of hulls 12. The upper ends of girder columns 57 converge to support a base structure B on which derrick 56 may be rotated. Obviously, other types of supporting structures may be formed and the foregoing is considered exemplary only.

It will be understood that derrick 56 is secured tothe vessel such that the pivotal axis thereof extends vertically when the vessel lies in calm water, i.e., its equilibrium portion. Also, the derrick is mounted such that the pivotal axis thereof lies in the vertical plane intersecting the horizontal centerline of the vessel whereby the weight of the derrick is equally distributed to each of hulls 12. The crane 56 more particularly comprises a counterweight 59, a mast structure 61 carrying tackle 62 and load blocks and hooks 64 arranged in a conventional manner. A Dutch pintle crane, known to the art, is preferably employed herein, but it will be understood that derrick 56 may comprise any commercially available heavy duty crane. For example, a tub type crane may be employed. In the preferred form hereof, a crane having a capacity of 500 tons in slewing is provided.

Figure 3:
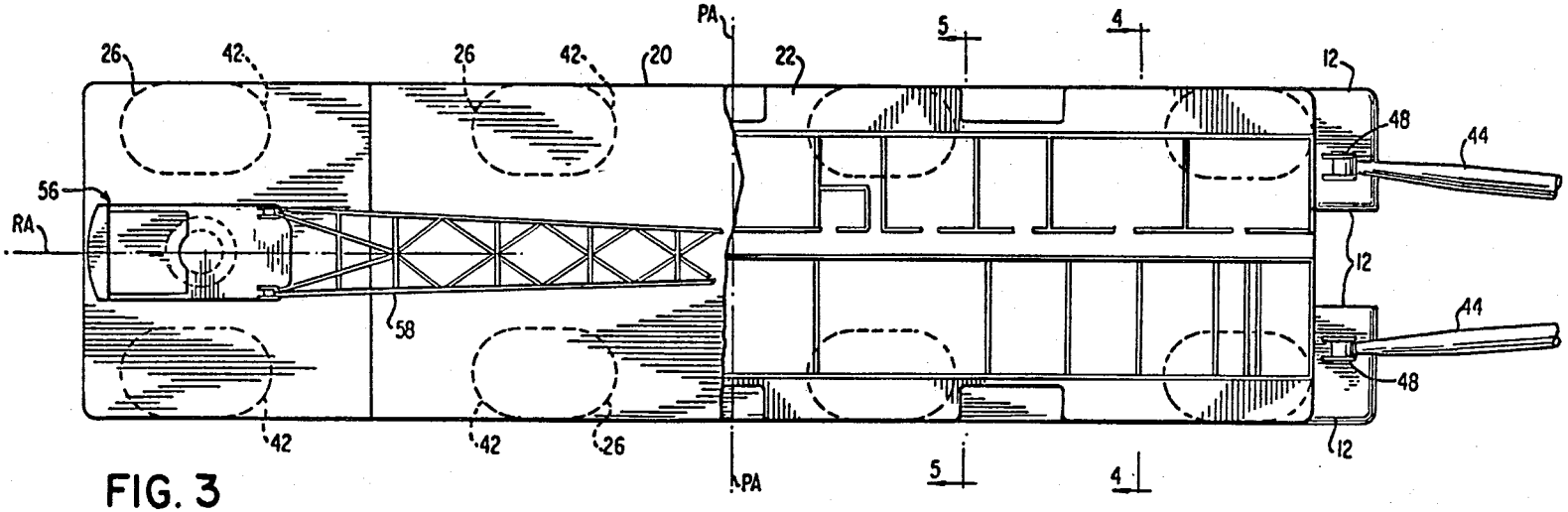
FIG. 3 is a plan view of the derrick barge with portions broken out for ease of illustration.

Columns 26, in the preferred form, are disposed along outboard portions of hulls 12 as shown in FIGS. 3 and 5. The outboard sides of columns 26 are in vertical alignment with and form continuations of the outboard sides of the associated hulls. The displacement and stability requirements of columns 26 are such that their longitudinal axes preferably are spaced laterally outwardly of the centerline of the hulls. The centroids of the water plane areas defined by the cross sections of the columns 26 are located an extended distance from the centerline of the vessel on opposite sides thereof to develop large moments of inertia of the water plane areas about the roll axis.

As seen in FIG. 2, anchor winches 35 are disposed in the forward and stern pairs of columns 26 and carry anchor lines 36 disposed about suitable mooring pulleys. Lines 36 carry anchors, not show, whereby vessel 10 can be moored at the construction site. Also, as seen in FIG. 1, suitable fenders 37 may be provided hulls 12 and columns 26.

Figure 8:
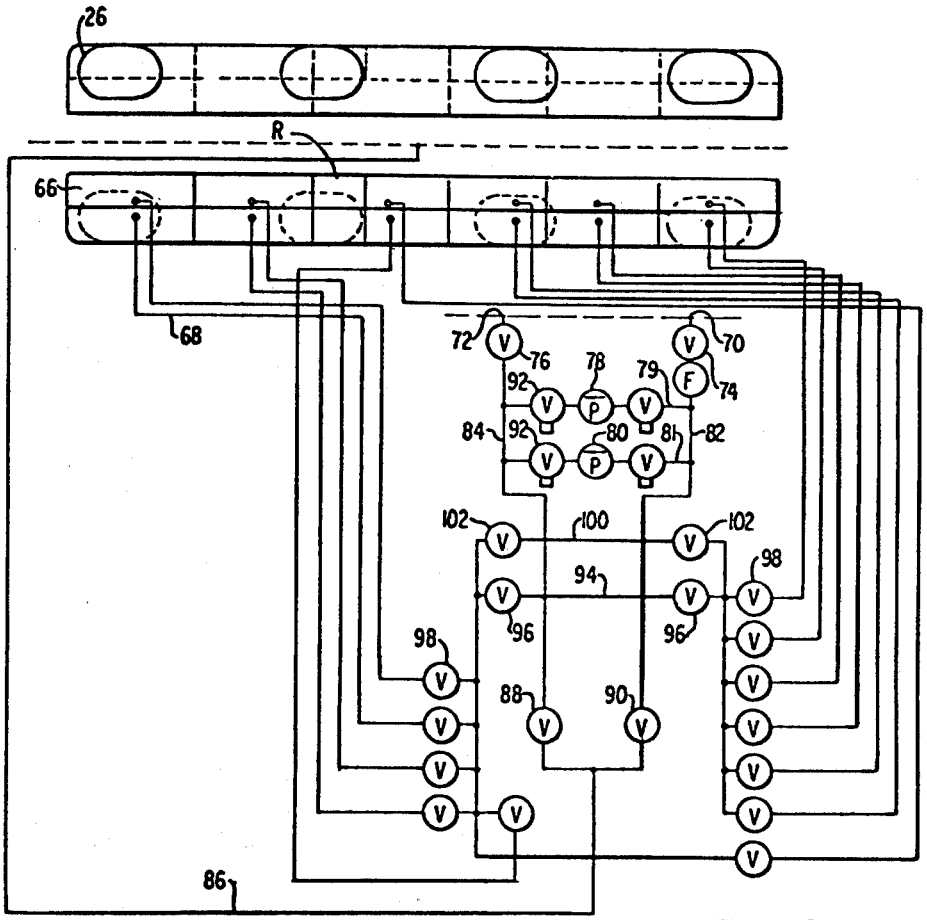
FIG. 8 is a schematic plan view of the hulls of the derrick barge illustrating a ballast system therefor.
Figure 11:
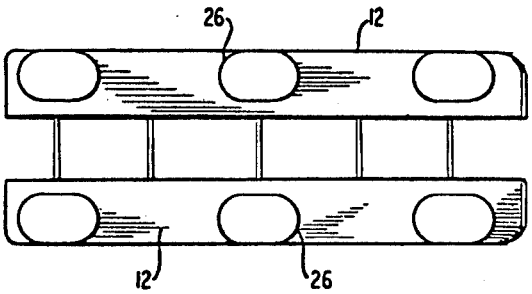
FIG. 11 is a diagrammatic horizontal cross-sectional view between deck and hull illustrating another embodiment of the derrick barge hereof.

As seen in FIG. 8, hulls 12 are each divided into compartments 66 forming a plurality of ballast chambers for submerging and refloating the vessel, and it will be understood that any number of compartments 66 may be provided as desired to perform the intended ballasting function. While only the starboard hull and ballast system therefor is illustrated in FIG. 8, it will be understood that the port hull is similarly arranged and ballasted but on the opposite hand. Also, the port hull and bilge system therefor is illustrated in FIG. 8, and it will be understood that the starboard hull is similarly arranged and of the opposite hand. Ballast chambers 66 are selectively and independently ballasted and deballasted whereby the vessel may be submerged with the platform P remaining substantially level throughout the submergence thereof and any attitude deviation of the vessel in both heel and trim may be corrected during submergence and retention of the vessel at the semisubmerged depth. Ballast chambers 66 may also be selectively and independently or dependently ballasted and deballasted when the vessel is semisubmerged to provide a transverse vessel inclination about its heel axis to enhance the comfort, safety and effectiveness of the operating personnel and to assist derrick operations when necessary and in a manner described hereinafter. To these ends, a plurality of conduits 68 extend from a pump room PR in each of hulls 12 in opposite longitudinal directions to the several ballast compartments 66, there being multiple compartments in the forward and aft portions, respectively, of each hull.

Pump room PR is provided with a sea-suction inlet indicated at 70 and an overboard discharge indicated at 72 controlled by suitable power operated gate valves 74 and 76 respectively, the hull side being indicated by the dashed lines in FIG. 8. A pair of pumps 78 and 80 are connected in parallel via lines 79 and 81 respectively across conduits 82 and 84, conduit 82 connecting with inlet 70 and conduit 84 connecting with discharge 72. Conduits 82 and 84 connect with a conduit 86 and it will be seen that, with valves 88 and 90 closed, pumps 78 and 80 suction sea water through inlet 70 past suitable valves 92 located in the parallel pump lines 79 and 81, and into conduit 84 which, with valves 76 closed, communicates with a main ballast conduit 94. Opposite ends of main conduit 94 are connecte in parallel with ballast conduits 68 through a pair of power operated valves 96 located on opposite sides of feed conduit 84, ballast conduits 68 each having a suitable power operated valve 98. Thus, with valves 74, 92, 96 and 98 open and valve 76 closed, the 12 ballast compartments may be simultaneously ballasted with sea water at an equal rate to maintain the platform substantially level when the vessel is being submerged or the valves 98 may be selectively operated to control the ballasting of the individual compartments 66 whereby the trim of the vessel may be corrected or altered during submergence, retention of the vessel in the semisubmerged condition, and during operation of derrick 56 as hereinafter described. Line 86 is used to transfer ballast between one hull and the other.

Conduit 82 connects with a deballasting conduit 100 having suitable power operated valves 102 on opposite sides of the connection, opposite ends of deballasting conduit 100 connecting across ballasting conduit 94 between valves 96 and the first of the parallel connected conduits 68. To refloat the vessel with the hulls 12 having freeboard, valves 74 and 96 are closed and valves 76 and 102 are opened. Pumps 78 and 80 operate to pump water in the same direction as before and accordingly suction main deballasting conduit 100 via conduit 82, thereby suctioning ballast conduits 68 and withdrawing ballast water from compartments 66 via conduits 68, 100 and 82, the pump lines 79 and 81, open valve 76 and outlet 72. With all of valves 98 open, compartments 66 may be simultaneously deballasted as desired to effect refloatation of the vessel to the surface floating condition with hulls 12 having freeboard f. Selected operation of valves 98 with valves 76 and 102 open and valve 74 closed deballasts selected compartments 66 as desired to alter the attitude of the vessel about the heel and trim axes end to assist in the operation of derrick 56 when necessary as hereinafter described. It is thus readily seen that compartments 66 may be simultaneously ballasted and deballasted or selectively ballasted and deballasted or having ballast transferred between the port and starboard hulls by selected operation of the various valves and that this can be accomplished when the vessel is in any operating condition, for example, floating with the hulls having freeboard, semisubmerged floating or any intermediate position during submerging or refloating operations wherein the attitude of the vessel about heel and trim axes is to be altered. Note also that the various valves, conduits, etc. of the foregoing ballast system are provided each hull 12 whereby one or both hulls may be ballasted or deballasted alone or together, or ballast transferred.

It is a significant feature of the present invention that vessel 10 can be towed or self-propelled, by means not shown, between work sites at speeds in the order of 8 to 10 knots providing the present vessel with a mobility heretofore unavailable in prior semisubmersible type vessels (with the exception of the vessel disclosed in the aforementioned parent application Ser. No. 666,395). To this end, hulls 12 have a displacement when deballasted to support the entire weight of the vessel, including derrick 56, crew, auxiliary equipment and the like as well as a heavy deck load, with the hulls 12 having freeboard f. When in the latter surface floating condition, vessel 10 has the great righting stability and decreased roll angles characteristic of a twin hull type vessel. It will be seen that the support structure for platform 20 including truss formations 24 and stabilizing columns 26 are disposed above the waterline and accordingly do not present a frontal area to the water to offer resistance to passage therethrough. In the floating condition, only twin hulls 12 displace water and the substantially streamline shape thereof as well as the absence of support structure in contact with the water permit movement of the vessel at significantly higher speeds than heretofore possible with prior semisubmersible vessels (with the exception of the vessel disclosed in the aforementioned parent application Ser. No. 666,395).

When vessel 10 reaches the work or construction site for the purpose of erecting or dismantling a marine structure such as an oil drilling or production platform or other offshore marine structure, anchors, not shown, are deployed to maintain vessel 10 in proper position. It is understood that a dynamic position keeping system could be employed in lieu of the conventional anchoring system mentioned herein.

For normal wave conditions and with the vessel in the surface floating condition with hulls 12 having freeboard f, derrick 56 could be operated to lift and transfer loads up to its full tonnage capacity when servicing adjacent structure. In moderate or heavier sea states, for example wave heights in excess of 5 or 6 feet, servicing operations with a conventional derrick barge would at this point cease because of excessive vessel motions in roll, pitch and heave and not be continued until a sea state prevailed which would preclude such vessel motions. However, a semisubmersible vessel constructed in accordance with the present invention can continue to perform its function even in sea states having wave heights exceeding 5 or 6 feet in a manner as will now be described.

When vessel 10 is at the work site and derrick operations in the semisubmerged condition are to be conducted, hulls 12 are ballasted preferably by simultaneously ballasting the compartments 66 in each hull in the previously described manner to submerge hulls 12 below the waterline. Vessel 10 is preferably submerged to the extent that columns 26 are submerged for approximately half their effective height h, thereby locating the mean waterline above the upper surfaces of hulls 12 at a distance of approximately half the distance between lower deck 22 and the upper surface of hulls 12. The displacement of the submerged portions of columns 26 and the residual displacement of hulls 12 are adequate to maintain the vessel in the floating semisubmerged condition at such predetermined height. In this manner, the maximum anticipated wave is prevented from acting against hulls 12 and platform P and acts only on the columns 26 and in the open frame area between the hulls and the platform. This reduces the adverse effect of wave action on the vessel which now has excellent motion minimizing characteristics in the floating semisubmerged condition. When the vessel is in the semisubmerged condition, anchor lines 36 are made taut to maintain the vessel in proper servicing position relative to the construction site.

It will be noted that the primary purpose of the semisubmersible vessel is to minimize vessel motion due to wave action. Ideally, this is accomplished by submerging the vessel to approximately one-half the effective height of columns 26 thus precluding wave action against the deck structure as well as the hull structure so that only the exposed columns 26 and trusses 24 between platform P and hulls 12 are exposed to the wave action. The present semisubmersible derrick barge can accordingly operate efficiently in much higher sea states than derrick barges of known types, for example, in sea states having waves 11 and 12 feet in height or higher. (Of course, there is an upper limit as to the wave height in which even the present semisubmersible barge can operate efficiently, and beyond that derrick operations must be suspended until the sea subsides.) However, even when this semisubmersible vessel is operating within design limits in the semisubmerged condition with motion minimizing characteristics afforded by the described vessel construction, there is some vessel response to wave action, i.e., the wave action against columns 26 and trusses 24. Because of this, when the natural period of the ship is the same as or close to the period of the types according to existent sea conditions, there is amplification of vessel motion which may become so excessive as to interfere with derrick operations, even though the vessel is semisubmerged to the usual operating condition wherein the mean waterline is at approximately one-half the effective height h of stabilizing columns 26. It is thus necessary and desirous to alter the motion of the vessel when such motion amplification occurs and this can be accomplished by either ballasting or deballasting the vessel within certain predetermined limits to submerge or emerge the vessel to a greater or lesser extent from the ideal submergence which locates the mean water surface one-half the effective height h. The maximum variation of submergence of the vessel from the ideal submergence by ballasting or deballasting the vessel is, however, limited to distances within a range which do not reorient the vessel to a position wherein wave action against the vessel causes excessive impact. Thus, to preclude excessive vessel motion and impact caused by the interaction of vessel and wave motion, the maximum variation, i.e., submergence or emergence of vessel 10 as by ballasting or deballasting, respectively, from the ideal submergence of one-half h, is such that the distance between the mean water surface and either the underside of the lower deck 22 or the top side of hulls 12 is not less than 0.75 of the mean wave height. FIG. 9 illustrates a pair of permissible mean waterlines relative to the vessel for a particular wave height under this criteria. The preferred variation from the ideal submergence provides for deballasting the vessels such that there is less splash against the lower deck 22. In addition to ballasting and deballasting the natural period of the vessel in pitch and roll may be varied by redistribution of the ballast within the vessel. This can be accomplished through ballast transfer between compartments, toward or away from, the ship's extremities, as the conditions may necessitate, i.e., transversely or longitudinally of the vessel. In this manner, all vessel motions caused by wave action can be minimized.

It is a significant feature hereof that the foregoing vessel has optimal stability characteristics in the floating submerged condition. The columns are designed to provide a large water plane area at all the aforementioned depths of submergence to afford an adequate righting moment to return the vessel to a level position. The vessel is designed such that there are long periods of roll, pitch and heave. Particularly, the columns provide a roll sufficiently slow as to preclude tossing about of operating personnel on platform P and a roll rate sufficiently fast to provide adequate stability about the roll axis. The vessel attitude about heel and trim axes can be corrected by selected ballasting of compartments 66. The stability characteristics and motion minimizing characteristics thus afforded the vessel are optimum for a vessel of the foregoing construction.

Since the displacement of hulls 12 is considerably larger than the displacement of the submerged portions of columns 26, the lifting of a like load when the crane is similarly oriented in the floating and semisubmerged conditions causes the vessel to roll to a greater load induced heel angle in the semisubmerged condition than in the floating condition. The operational capacity of crane 56 when vessel 10 is semisubmerged is thus limited to predetermined values expressed in the net moment caused by load W so as to preclude excessive load induced heel angles. It has been found statistically that the vast majority of marine construction operations of the type contemplated herein require a crane lifting capacity of 250 tons or less. The capacity of the present derrick in the preferred form is 500 tons slewing and 800 tons fixed and this capability is fully obtained when the vessel lies in the surface floating (low draft) condition. The vessel is configured, i.e., the hulls and columns are designed and located to maintain the vessel within a permissible range of heel angles when operating in the semisubmerged condition for loads up to 250 tons disposed at a maximum predetermined radius normal to the vessel centerline. The range of weights and distances thereof from the centerline of the vessel, i.e., the operating limits of the derrick barge in the semisubmerged condition, are dependent upon the physical configuration of the vessel's hulls and columns and in an illustrative preferred embodiment hereof, vessel 10 has an overall length of 400 feet at hulls 12 with each hull having a beam of 38 feet and an inside spacing of 30 feet one from the other, providing an overall hull beam of 106 feet. The effective height h of the stabilizing columns 26 is 23.0 feet. The centroids of bottles 26 are equally spaced 39 feet from the vessel's longitudinal centerline. The pairs of columns 26 are longitudinally spaced one from the other 63.25 feet with the bow pair of columns being spaced 19.75 feet from the bow of hulls 12. The length of each column 26 is 46 feet and the width is 28 feet with the ends thereof being formed cylindrical in shape providing an overall area of approximately 1119.5 square feet per column.

To refloat the vessel, the anchor lines, not shown, are loosened or the anchors shipped aboard and ballast compartments 66 are pumped to evacuate the water therein as hereinbefore described. The combined hull displacement and the submerged column displacement is sufficient to raise the vessel to the surface floating condition with hulls 12 having freeboard indicated as f in FIG. 2, the stabilizing columns 26 acting continuously to stabilize the vessel during refloating operations.

The vessel is self-contained in that crew's quarters, auxiliary equipment, and the like are all on board and can provide these facilities to the serviced vessel or structure, as well as to auxiliary accompanying vessels. Particularly, the crew's quarters are located on lower deck 22 leaving ample space on main deck 20 for locating other heavy equipment and carrying large deck loads. Auxiliary equipment, crew's quarters, etc. may be located within columns 26 in addition to being located on platform P. As seen in FIGS. 1 and 2, a control house 110 is disposed on main deck 20 adjacent the foreward end and port side of vessel 10 and a boom rest is provided for boom 58 while vessel 10 is in transit.

It will be noted that the vessel may be ballasted in the semisubmerged condition to compensate for and minimize transverse inclinations about the heel axis caused by crane operations. For example, slewing of crane 56 in either the loaded or unloaded conditions induces an inclination about the heel axis of the vessel due to the asymmetrical location of the load and/or counterweight. For those derrick barges employing a crane having a small permissible heeling angle d (the angle between true vertical and the vertical axis of rotation of the crane) beyond which the crane will not rotate, such induced heel angle in combination with the dynamic rolling characteristics of the vessel may provide a total inclination of vessel 10 exceeding the permissible crane angle d thereby precluding derrick operations.

Accordingly, to provide for the comfort and safety of the operating personnel and to retain crane slewing capability wherein the latter described cranes are employed, the vessel may be ballasted in a predetermined manner in accordance with the rotational movement of the crane to maintain the vessel heel angle within predetermined limits. To this end and referring to FIGS. 10*a–d* wherein vessel 10 is illustrated in the onloading semisubmerged floating condition, the port hull 12P may be ballasted to incline the vessel from the even keel crane to aft position illustrated in FIG. 10*a* to the ballasted condition illustrated in FIG. 10*b* providing a heel angle e. To pick up a load W off the port side, the unloaded crane is slewed to the port side and counterweight 59 causes the vessel to incline about its heel axis in the opposite direction assuming a heel angle of e'. A load W may then be picked up by means of load blocks 64 whereupon the vessel inclines counterclockwise about its heel axis to the position illustrated in FIG. 10*d* assuming a heel angle g. Note that the ballast, ballasted counterweight and ballasted load induced heel angles e, e' and g respectively incline the vessel to smaller heel angles than would otherwise be the case if the vessel were not ballasted in the foregoing manner. Such induced angles also lie within the permissible heeling angle d where such cranes are employed whereby slewing capability is retained. To offload the vessel, i.e., to transfer load W from the vessel to a point outboard thereof, the operation is reversed and, of course, onloading or offloading may be conducted from either the port or starboard sides of the vessel with the port or starboard hull being ballasted as the case may be. The above illustrates one set of conditions. The ballast system may assist in any case where loads should be balanced and heel angles reduced. Also, when employing shear leg 46 near or at its full capacity of 2000 tons, compartments 66 located in the stern portion of the vessel may be ballasted to offset and minimize the load induced trim angle.

While the preferred form of the vessel described herein provides an even number of pairs of columns on opposite sides of the pitch and roll axes in a generally symmetrical relation thereabout, an odd number of pairs of columns can be provided as illustrated in FIG. 10. It is seen in this form that a pair of columns are spaced on opposite sides of the pitch axes adjacent fore and aft portions of the vessel with a central pair located such that the pitch axis preferably intersects the same, the columns being symmetrically arranged on opposite sides of the roll axis.

Certain basic principles are employed in the construction of the present vessel:

(1) A pair of elongated, laterally spaced hulls 12 in substantially parallel relation are employed to provide greater towing speeds as well as high stability.

(2) The hulls have sufficient displacement to float the vessel having a large deck load and a heavy duty crane of the aforementioned type with the hulls having freeboard.

(3) The hulls are compartmented for ballasting and selected compartments in both hulls may be ballasted and deballasted to submerge the vessel and to induce predetermined heel or trim angles in the semisubmerged condition. Ballast may also be transferred between the hulls.

(4) The vessel should have at least four stabilizing columns 26, with half of the columns being disposed on each hull on opposite sides of the roll axis RA. When six columns are provided, a first and second pair of such columns are located on opposite sides of the pitch axis PA (passing through the center of flotation), with the third middle pair of such columns located adjacent or intersected by the pitch axis. When eight stabilizing columns are employed, the same number of pairs are located generally symmetrically on opposite sides of and spaced from the pitch axis.

(4b) More specifically, if an odd number of pairs of stabilizing columns are employed, the middle pair should be adjacent the pitch axis PA and the other pairs of columns should be disposed in equal numbers on opposite sides of the pitch axis PA and in a generally symmetrical relation; whereas when an even number of pairs of stabilizing columns are employed, the same number of pairs are located on the opposite sides of the pitch axis PA in a generally symmetrical relation thereto.

(5) To stabilize the vessel, each of the columns 26 should have a predetermined area which is constant in cross section throughout the effective height thereof.

(6) The stabilizing columns 26 are constructed so that their lower halves provide a combined displacement together with the residual displacement of the partially ballasted hulls 12 so as to float the vessel in a semisubmerged condition.

(7) The effective height of the stabilizing bottles 26, which is defined by the distance h between the upper surfaces of hulls 12 and the underside of platform P, may be equal to and preferably greater than the maximum anticipated wave height from crest to trough, such height being substantially unaffected by any slight changes in configuration for the mechanical connection between the columns and either of the hulls and platform.

(8) The vessel is ballasted to a submergence of approximately one-half the effective height of the stabilizing columns to maintain the vessel in a semisubmerged floating condition. To minimize vessel motion amplification under such conditions when necessary, ballast is redistributed and/or the vessel is ballasted to submerge or emerge to a greater or lesser extent from the ideal semisubmerged condition such that the distance between the mean water surface and either the underside of the deck or top side of the hull is not less than 0.75 of the mean wave height, i.e., the effective height h is at least equal to and preferably greater than 1.5 times the mean wave height.

(9) When semisubmerged and inclined about the heel axis in the load and/or ballast induced condition, the stabilizing columns provide righting moments about the roll axis RA in proportion to their cross sectional area and the square of their distance from the roll axis.

(10) The hulls 12 in the semisubmerged floating condition can be selectively ballasted to compensate for and minimize crane induced vessel inclination providing for increased comfort and effectiveness of the operating personnel and retaining crane slewing capability in those instances where cranes having small permissible heeling angles are employed.

(11) When shear leg 46 operates at or near its capacity, the stern portion of the vessel may be ballasted to minimize excessive shear leg load induced trim angles.

SUMMARY OF CONSTRUCTION AND OPERATION

Thus, the present invention provides a twin hull, semisubmersible derrick barge having a plurality of spaced connecting members including upstanding stabilizing columns 26 fixed at their lower ends to a pair of laterally spaced, elongated parallel hulls 12. The members support a platform P including crew's quarters and machinery spaces, and a heavy duty crane above hull 12 a distance at least as great as the effective height h of columns 26. The spaced hulls are compartmented to provide ballast tanks 66 which are deballasted when the semisubmersible is towed to and from work sites to provide sufficient hull displacement to support the semisubmersible vessel (including the heavy duty crane, crew's quarters, machinery spaces and deck load) with the hulls having freeboard. At the work site and with mild sea conditions, the crane may be operated in the usual manner lifting and transferring loads up to its capacity, in this instance 500 tons slewing and 800 tons fixed or the shear leg may be operated to its maximum lift capacity, in this case 2000 tons. Upon encountering heavy seas, tanks 66 are ballasted to submerge the hulls normally to a distance about one-half the effective height of stabilizing columns 26 which is about one-half the height of the maximum anticipated wave whereby platform P and the derrick remain supported above the maximum anticipated wave height. The displacement required to support the vessel in the semi-submerged floating condition is provided by the hulls and portions of the stabilizing columns 26, the vessel in this condition being otherwise unsupported. The hulls and bottles are configured and located to provide excellent motion minimizing characteristics under wave action in the semisubmerged condition. When vessel and wave motion interact to amplify the vessel motion in the semisubmerged condition, the vessel may be ballasted or deballasted to a greater or lesser extent from the ideal semisubmerged condition, i.e., one-half the effective height of columns 26, such that the distance between either the underside of the deck or top side of the hull is not less than 0.75 of the mean wave height.

The ability of the present semisubmersible vessel to provide a substantially stable and limited motion floating base in the semisubmerged condition for various wave states is highly significant as it permits operation of the vessel's derrick in heavy sea states whereas prior derrick barges are incapable of derrick operations due to excessive vessel motion. By submerging the twin hulls to half the effective height of columns 26 or within the foregoing limits to preclude vessel motion amplification, wave action against hulls 12 and work platform P is substantially eliminated, and waves act only against the relatively small area of the columns, open support structure and framework between work platform P and hulls 12 and the derrick support structure, thus minimizing vessel motion due to wave action. The hulls 12 may also be selectively ballasted to counter derrick induced heel angles, thereby minimizing transverse inclinations of the vessel and enhancing the safety, comfort and effectiveness of the operating personnel. The columns are located such that the hydrodynamic forces act to establish righting moments proportional to the volumetric displacement of the submerged portions of the stabilizing columns about the roll and pitch axes to locate and maintain the metacenter above the center of gravity of the vessel for all of the foregoing floating semisubmerged positions of the vessel.

When the construction work is completed, compartments 66 are deballasted to refloat the vessel with hulls 12 having freeboard f. The boom 58 is positioned in a substantially horizontal position resting on the boom rest and the vessel is ready for transit in the surface floating condition to other construction sites.

It will be appreciated that the foregoing described vessel may be employed in virtually any type of marine construction operation and is in no way limited to the erection and dismantling of offshore drilling and production platforms. For example, the present vessel may be employed to lay pipe, build bridges, construct offshore oil storage tanks, and the like, and may even be employed in the construction of other vessels.

This invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A column stabilized semisubmersible barge for marine construction, pipelaying and like other offshore operations, said barge being characterized by:

a pair of elongated hulls disposed in substantially parallel spaced side-by-side relation with each of said hulls spaced from and lying on an opposite side of the longitudinal centerline of said barge;

a working platform spaced above said hulls a predetermined height and normally lying in a generally horizontal plane;

means for supporting said platform in fixed spaced relation above said hulls including at least three pairs of upstanding columns connecting with each of said hulls and said platform; each of said columns having a substantially constant cross sectional area over the effective height of the column;

each of said hulls having, over substantially the entire length thereof, a substantially rectangular transverse cross section with its breadth greater than its height;

a plurality of longitudinally spaced structural means interconnecting and reinforcing the structural relationship of the hulls, platform and columns, with such structural means including substantially transversely extending members structurally interconnecting uppermost portions of the hulls;

said barge being generally rectangular in plan with the length of said barge along its longitudinal centerline and roll axis being substantially greater than the width of said barge along its transverse centerline and pitch axis;

at least three of said columns being located on each of said two hulls on opposite sides of the barge's roll axis with pairs of such columns being located near opposite ends of each of said hulls on opposite sides of the barge's pitch axis and another pair of said columns being located at an intermediate position of each of said hulls;

each of said columns having an oblong cross section with its dimension extending in the direction of the barge's longitudinal axis being greater than the column's dimension extending transversely of the barge's longitudinal axis;

the centroid of the cross section of each column being disposed on said hulls outboard of the longitudinal centerline of the associated hull;

the outboard sides of said oblong columns on each hull being substantially in vertical alignment with the outboard side of the associated rectangular twin hull;

the configuration and cross-sectional area of said columns throughout effective height thereof and the distances of said columns from the barge's longitudinal roll axis and transverse pitch axis being such that said columns provide sufficient righting moments about roll and pitch axis when the barge is in high draft semisubmerged operating positions and also being such that said columns provide a righting moment about the barge's transverse pitch axis which is greater than the righting moment provided about the barge's longitudinal roll axis when the barge is in semisubmerged column stabilized operating positions;

said hulls having ballast compartments with each of said hulls including a plurality of separate ballast compartments spaced transversely within each hull and a plurality of separate ballast compartments spaced longitudinally within each hull;

means for ballasting said barge when required to alter its draft between a low draft hull-supported floating condition in which the hulls have freedboard with said transversely extending members which structurally interconnect uppermost portions of the hulls being disposed above the mean waterline and a high draft semisubmerged column stabilized floating and operating condition in which the mean waterline is located along intermediate portions of said columns above said hulls and below the underside of said platform;

crane means located on said barge near one end thereof and mounted for rotation about a normally substantially vertical axis, said crane means being of sufficient size and capacity for various marine construction and other like offshore operations and having a boom of sufficient length to perform operations off at least one beam of the barge and off the end of the barge near which said crane means is located;

said means for ballasting including means for adjusting vessel angle of heel change caused during semisubmerged derrick barge operations to provide a reduction of the barge's angle of heel about its roll axis when required during semisubmerged column stabilized operations; and said means for ballasting including means for adjusting vessel angle of trim change caused during semisubmerged barge operations to provide a reduction of the vessel's angle of trim about its pitch axis when required during semisubmerged column stabilized operations.

2. A barge according to claim 1, wherein said ballast means includes means for transferring ballast from one of said rectangular twin hulls directly to the other of said rectangular twin hulls for controlling heel of said barge about its roll axis when required during semisubmerged column stabilized barge and crane means operations.

3. A barge according to claim 1, wherein said rotatable crane means has an axis of rotation lying in a vertical plane containing the roll axis of the barge.

4. A barge according to claim 1 wherein the length of said barge is at least plural times as great as the width of said barge.

5. A column stabilized semisubmersible barge for marine construction, pipelaying and like other offshore operations, said barge being characterized by:

a pair of elongated hulls disposed in substantially parallel spaced side-by-side relation with each of said hulls spaced from and lying on an opposite side of the longitudinal centerline of said barge;

a working platform spaced above said hulls a predetermined height and normally lying in a generally horizontal plane;

means for supporting said platform in fixed spaced relation above said hulls including at least three pairs of upstanding columns connecting with each of said hulls and said platform and each of said columns having a substantially constant cross section over the effective height of the column;

each of said hulls having an oblong transverse cross section with a breadth greater than its height and having top and bottom substantially planar parallel surfaces extending substantially the entire length of each hull;

a plurality of longitudinally spaced structural means interconnecting and reinforcing the structural relationship of the hulls, platform and columns, with such structural means including substantially transversely extending members structurally interconnecting uppermost portions of the hulls;

said barge being generally rectangular in plan with the length of said barge along its longitudinal centerline and roll axis being substantially greater than the width of said vessel along its transverse centerline and pitch axis;

at least three of said columns being located on each of said two hulls on opposite sides of the barge's roll axis with pairs of such columns being located near opposite ends of each of said hulls on opposite sides of the barge's pitch axis and another pair of said columns being located at an intermediate position on each of said hulls;

each of said columns having an oblong cross section with its dimension extending in the direction of the barge's longitudinal axis being greater than the column's dimension extending transversely of the barge's longitudinal axis;

the centroid of the cross section of each column being disposed on said hulls outboard of the longitudinal centerline of the associated hull;

the configuration and cross-sectional areas of said columns throughout effective height thereof and the distances of said columns from the barge's longitudinal roll axis and transverse pitch axis being such that said columns provide sufficient righting moments about roll and pitch axes when the barge is in high draft semisubmerged operating positions and also being such that said columns provide righting moment about the transverse pitch axis which is greater than righting moment provided about said longitudinal roll axis when the barge is in semisubmerged column stabilized operation position;

crane means located on said barge near one end thereof and mounted for rotation about a normally substantially vertical axis, said crane means being of sufficient size and capacity for various marine construction and other like offshore operations, and having a boom of sufficient length to perform operations off at least one beam of the barge and off the end of the barge near which said crane means is located;

said hulls having ballast compartments with each of said hulls including a plurality of separate ballast compartments spaced transversely within each hull as well as a plurality of separate ballast compartments spaced longitudinally within each hull;

means for ballasting said barge when required to alter its draft between a low draft hull-supported floating condition in which the hulls have freeboard with said transversely extending members actually structurally interconnecting uppermost portions of the hulls being disposed above the mean waterline and a high draft semisubmerged column stabilized floating and operating condition in which the mean waterline is located along intermediate portions of said columns between about 0.25 the length of the columns above the tops of said hulls and about 0.25 the length of the columns below the underside of said platform, said intermediate portions of said columns having a substantially constant cross section over an effective height at least above said hull tops and below said platform bottom as aforesaid;

said means for ballasting including means for adjusting barge angle of heel change caused during semisubmerged column stabilized operations of said barge and crane means to reduce the barge's angle of heel about its roll axis when required during such semisubmerged operations;

said means for ballasting including means for adjusting barge angle of trim change caused during column stabilized semisubmerged operations of said barge with such crane means to reduce the barge's angle of trim about its pitch axis when required during such semisubmerged operations.

6. A barge according to claim 5, wherein said barge ballast means includes means for transferring ballast directly from one hull to the other to control heel of said barge about its roll axis during semisubmerged column stabilized barge and crane means operations.

7. A barge according to claim 5 wherein each of said hulls is generally rectangular in cross section.

8. A barge according to claim 7 wherein the outboard sides of said oblong columns on each hull are substantially in vertical alignment with the outboard side of the associated hull.

9. A barge according to claim 5 wherein the length of said barge is at least plural times greater than the width of said barge.

10. A barge according to claim 5, wherein at least the upper end of at least some of said columns is modified from said substantially constant cross section to provide mechanical connection between the columns and the platform.

11. A barge according to claim 10 wherein said modified column cross section includes a substantially frustoconical portion.

12. A barge according to claim 5 wherein at least the lower end of at least some of said columns is modified from said substantially constant cross section to provide mechanical connection between the columns and the associated hulls.

13. A barge according to claim 12 wherein said modified column cross section includes a substantially frustoconical portion.

14. A barge as in claim 5 wherein the barge has six columns including three columns on each hull, with one middle pair of columns located near the barge's transverse pitch axis and with two other pairs of columns on opposite sides of the barge's pitch axis in generally symmetrical relation thereto adjacent opposite ends of the associated hulls.

15. A barge as in claim 5 wherein: the barge has a total odd number of pairs of columns and the middle pair of columns is located adjacent the barge's pitch axis, with the remaining pairs of columns being disposed in equal numbers on opposite sides of the barge's pitch axis and with two pairs of columns located near opposite ends of said hulls.

16. A barge as in claim 5, wherein; the barge has a total even number of pairs of columns and the middle two pairs of columns are located on opposite sides of and near the transverse pitch axis of the barge; the remaining pairs of said columns being located outwardly of said middle pairs of columns and including two pairs of end columns on the hulls near opposite ends of said hulls.

17. A barge according to claim 5, wherein said crane means has an axis rotation lying in a vertical plane substantially containing the roll axis of the barge.

18. A barge according to claim 5, wherein the rotation axis of said crane means is located near one end of the barge at about the same distance from the transverse pitch axis as the pair of columns located near said end of the barge.

19. A barge as claimed in claim 5, including means for anchoring the barge in the high draft semisubmerged column stabilized barge and crane means operating positions, said means including mooring winches located near opposite ends of the barge.

* * * * *